US007566041B2

(12) United States Patent
Ibara et al.

(10) Patent No.: US 7,566,041 B2
(45) Date of Patent: Jul. 28, 2009

(54) PAGE HOLDER ENABLING UNENCUMBERED MANUAL PAGE TURNING

(76) Inventors: Steven Stewart Ibara, 6 Whitman Ct., San Carlos, CA (US) 94070; Crystal Gwen Steinke, 3494 Kilo Ave., San Jose, CA (US) 95124; Joel Harian Jones, 1745 Creek Dr., San Jose, CA (US) 95125; Vicky Greenbaum, 274 Belmont Ave., Redwood City, CA (US) 94061; David A. Woodley M. Packard, P.O. Box 1330, Los Altos, CA (US) 94023; Elisa Marie Jones, 1745 Creek Dr., San José, CA (US) 95125-1841

( * ) Notice: Subject to any disclaimer, the term of this patent is extended or adjusted under 35 U.S.C. 154(b) by 787 days.

(21) Appl. No.: 10/712,281

(22) Filed: Nov. 12, 2003

(65) Prior Publication Data

US 2005/0098702 A1 May 12, 2005

(51) Int. Cl.
*A47B 97/04* (2006.01)

(52) U.S. Cl. ..... 248/451; 248/444; 248/441.1

(58) Field of Classification Search ..... 248/441.1, 248/444, 447.1, 447.2, 448, 449, 451, 452, 248/453, 458, 465.1; 281/2, 8
See application file for complete search history.

(56) References Cited

U.S. PATENT DOCUMENTS

| | | | | | |
|---|---|---|---|---|---|
| 131,915 | A | | 10/1872 | Van Campen | |
| 458,074 | A | | 8/1891 | Shaw | |
| 2,810,231 | A | * | 10/1957 | Lykes | 248/451 |
| 3,813,075 | A | * | 5/1974 | Capper | 248/461 |
| 3,981,522 | A | | 9/1976 | Bloom | |
| 4,296,946 | A | * | 10/1981 | Larre et al. | 281/45 |
| 4,555,128 | A | * | 11/1985 | White et al. | 281/45 |
| 4,826,099 | A | * | 5/1989 | Johnson | 242/375 |
| 4,978,096 | A | | 12/1990 | Struckmann | |
| 5,377,946 | A | * | 1/1995 | Pannu | 248/456 |
| 5,855,329 | A | * | 1/1999 | Pagano | 248/451 |
| 5,884,889 | A | * | 3/1999 | Crosby | 248/460 |
| 5,979,857 | A | * | 11/1999 | Holm | 248/451 |
| 6,244,555 | B1 | * | 6/2001 | Benja-Athon | 248/441.1 |
| 6,375,165 | B1 | * | 4/2002 | Sherratt et al. | 256/24 |
| 2004/0076825 | A1 | * | 4/2004 | Hashimoto et al. | 428/375 |

OTHER PUBLICATIONS

Robert & Elsa Carvalho, Theresa Frazee, Linda Jansen, and Frank Prats, Responses to Evaluation, Oct. 25, 2003, San José, CA.

* cited by examiner

*Primary Examiner*—Amy J. Sterling

(57) ABSTRACT

An improved page holder comprising a clamp (10R) attached to a self-retracting reel (14), the latter being set at a predetermined tension to retain pages without prohibiting page turning, and having a tension adjustment dial (16) at its lower end. The reel (14) dispenses a monofilament (18) which extends across the reading matter (19) and attaches to a second clamp (10L). Thus the page holder can be applied in a variety of settings, and retains various reading matter (19) against wind, drafts, and the closing tendency of bound books, while enabling manual page turning.

20 Claims, 6 Drawing Sheets

PAGE HOLDER ENABLING UNENCUMBERED MANUAL PAGE TURNING

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to book holders, specifically to an improved page holder.

2. Discussion of Prior Art

For centuries, musicians have struggled with their sheet music. The battle to keep loose-leaf pages on the music stand and the pages of bound books open is a distraction that perpetuates to this day. Beyond the music field, this dilemma extends to public readings, ceremonies, and presentations. Many solutions have been proposed, but all have been problematic. All previously known counterparts require some sort of adjustment to permit page turning (including those that state otherwise). In every case, the page holder must be released and subsequently secured when a page is turned. This leaves the remaining pages vulnerable (e.g., to the wind) during the page turn, until the holder is replaced. Especially during a musical performance, anxiety over turning pages and securing the page holder threatens the quality and enjoyment of that performance. This is particularly true in the frequent cases when a quick page turn is necessary, and the problem is compounded by the fact that the musician usually has only one hand readily (and briefly) available.

Previously known page holders are dependent upon other hardware. This increases their cost and makes them cumbersome and ungainly. Their complexity requires undue time and effort to set up and operate. They are difficult to package, market, and distribute. They can only be used in certain settings, and are not easily adaptable for different materials and uses.

A plurality of page holders utilize a retaining line or strip, such as U.S. Pat. No. 4,978,096 to Struckmann (1990) and U.S. Pat. No. 5,377,946 to Pannu (1995). None provides a separate and independent device which can attach to various music holders, book holders, or loose-leaf page holders of varying design, material, and thickness. Furthermore, among the myriad of book holders, easels, copy holders, etc.—with their panels, clips, clamps, and bands—there has never been a solution to hold pages in place that does not interfere with page turning.

The problem has not been solved because it seems inconceivable that a device could exist which allows the user, but not the wind, to turn the page. Such a solution is long-overdue.

OBJECTS AND ADVANTAGES

Accordingly, several objects and advantages of our invention are to provide a page holder which is more simple, operable, lightweight, compact, and portable than any previously known counterpart. Our page holder is attractive and inexpensive; it is easy to package, market, and distribute. It is more convenient and expedient, producing a higher quality result than anything used before: it allows the user to simply turn the page, requiring no further action.

Our page holder provides the musician with greater confidence, knowing that the music is secure, but can be turned in a moment. The remaining pages require no further division of concentration, since they are automatically retained throughout the page turn. This allows the musician to relax and focus on performing. Our page holder can be stored in a few inches of an instrument case or accessory bag. Its versatility makes it easily adaptable to any setting, as it can be integrated or used in conjunction with existing hardware (such as binders, easels, music stands, book holders, clipboards, etc.). This compatibility has the added advantage of not wasting a user's previous purchase of such hardware.

Other objects and advantages are to provide a reliable page holder whose universal application transcends geographic and cultural boundaries, and which requires minimal change in production facilities. Because this device solves an existing, long-felt need, it can be readily put into practice by an eager market, and requires little or no learning to utilize.

Further objects and advantages of our invention will become apparent from a consideration of the drawings and ensuing description.

SUMMARY

In accordance with the present invention a page holder comprises a clamp bonded to a self-retracting reel, which exerts a tension between approximately 0.05 N (0.2 oz) and 0.6 N (2 oz). A retaining line is extracted from the reel and is attached to a second clamp.

DRAWINGS—FIGURES

DRAWINGS—REFERENCE NUMERALS

| | | | |
|---|---|---|---|
| 10R | right clamp | 10L | left clamp |
| 11R | weighted right clamp | 11L | weighted left clamp |
| 12R | rubber teeth | 12L | rubber teeth |
| 13R | magnet | 13L | magnet |
| 14 | self-retracting reel | 15 | hole |
| 16 | tension adjustment dial | 16A | alternate tension dial |
| 17 | support | 18 | monofilament |
| 19 | reading matter | 19A | varying lengths of paper |
| 19B | book | 20 | clipboard |
| 22 | alternate reel | 24 | rubber band |

DETAILED DESCRIPTION

Figure 1:
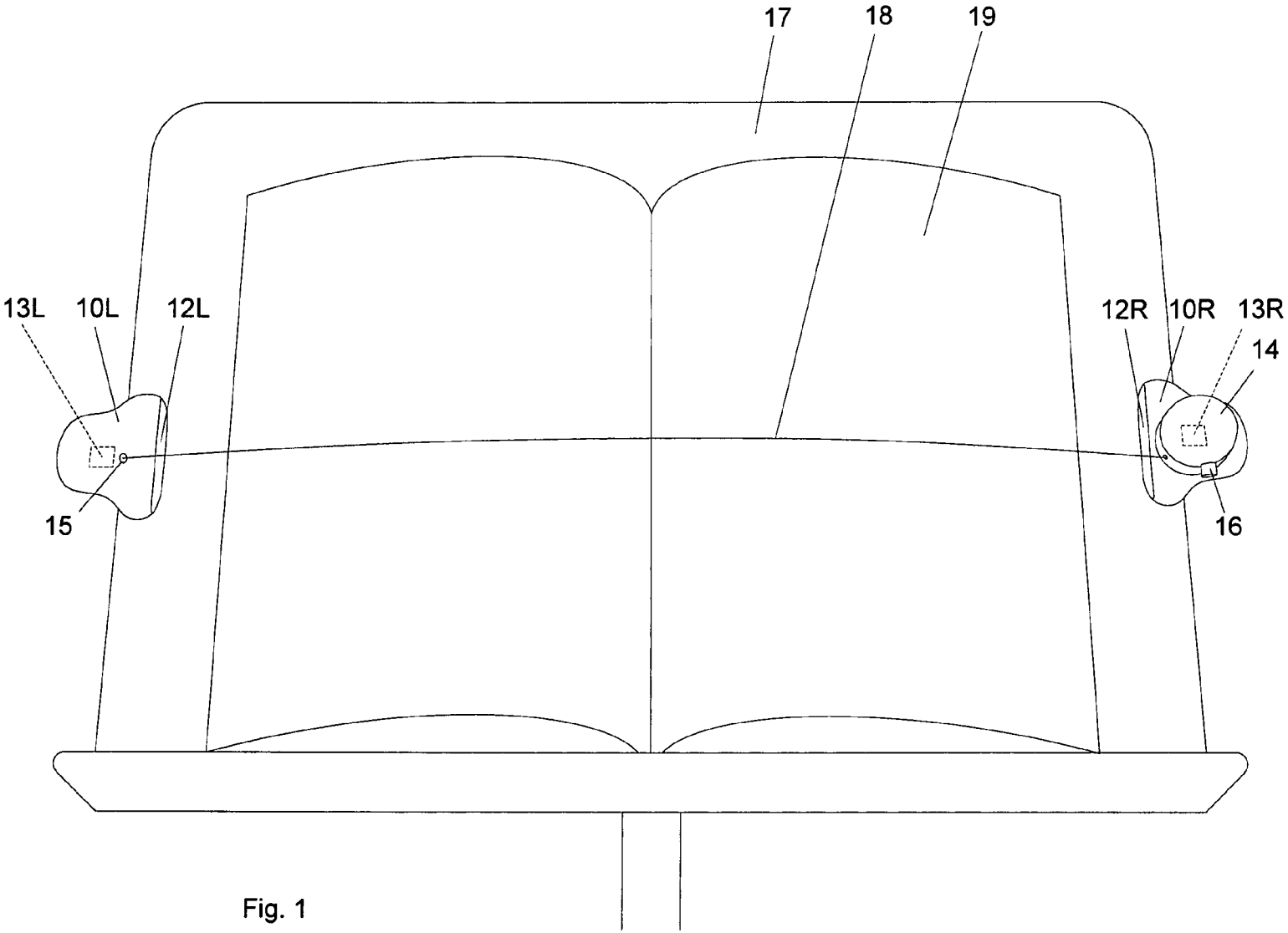
FIG. 1 is a perspective view of our invention.

FIG. 1—Preferred Embodiment

FIG. 1 shows a perspective view of a basic version of our page holder. A clamp 10R has rubber teeth 12R. A self-retracting reel 14 (a known device, utilized in several fields) is glued, welded, or bonded in any suitable fashion to clamp 10R. The reel 14 has a tension adjustment dial 16 at its lower end.

The reel 14 dispenses a monofilament 18, which extends across the reading matter 19 and is knotted, thermally bonded, or otherwise attached to a second clamp 10L. The clamp 10L also has rubber teeth 12L.

The clamps 10R and 10L can be made of metal, plastic, wood, or any suitable material. They can be approximately 5 cm (2 in) square. The rubber teeth 12R and 12L protect delicate surfaces, and prevent slippage on irregular surfaces such as music stands comprising thin, flat, metal bands.

The reel 14 can be made from metal or plastic, and in the preferred embodiment utilizes a metal spring. The casing can be approximately 3 cm (1.25 in) in diameter, and about 1 cm (0.5 in) thick. The reel 14 has a tension adjustable between approximately 0.05 N (0.2 oz) and 0.6 N (2 oz). This specific range holds the reading matter 19 in place, while allowing the user to turn the page against the monofilament 18 without damaging the reading matter 19. The tension can be varied by either increasing or decreasing the friction (drag) on the monofilament 18, or tightening/loosening the spring.

In the preferred embodiment, the monofilament 18 is made from 15-pound polyvinylidene fluoride (PVDF, or "Fluorocarbon"), such as that used in fishing line. PVDF is smoother and less refractive than ordinary monofilaments. Heavier-weight line is usable but less efficient, being more visually distracting, and requiring more space on the reel 14. Lighter weights can introduce threat of incision to the page's edge. The monofilament 18 could be approximately 1-1.5 m (3-5 ft) long.

The monofilament 18 is passed through a hole 15 (with a protective grommet or eyelet, not shown) drilled in metal clamp 10L and knotted, glued, or otherwise attached inside the clamp 10L. In the preferred embodiment, the clamps 10L and 10R can be compactly stored together with magnets 13L and 13R (shown here glued to the backs of clamps 10L and 10R) or other attaching components, or simply clamped together.

Operation

The manner of securing reading matter 19 with the page holder is exceedingly simple. The user attaches the clamp 10R to the right edge of the music stand, binder, easel, or other support 17 for reading matter 19. The user pulls the clamp 10L across the reading matter 19, extracting the monofilament 18 from the reel 14. The user then attaches the clamp 10L to the left edge of the support 17.

When a page is to be turned, the user simply grasps the page and turns it normally, exerting slight force to overcome the gentle tension of the reel 14. The page glides smoothly across the monofilament 18 as the reel 14 dispenses additional length to allow the page to turn. The monofilament 18 continues to provide retention at the edges of the remaining pages throughout the page turn. The reel 14 retracts automatically to secure the monofilament 18 across the pages in unison with the completion of the page turn.

Use of the lowest tension setting is most comfortable for the user, since it provides the least amount of resistance against the page. Use of low settings is also necessary for very thin pages, such as a minister's Bible at an outdoor wedding or funeral. (Particularly fragile pages can be turned under the edge of the monofilament 18 and "peeled" across to complete the page turn. Also, loose-leaf pages can be inserted into plastic sheet protectors, which will not interfere with the page holder's operation.) However, outdoor wind conditions frequently place the user at the mercy of unpredictable gusts. In the event of increasingly windy conditions, the user can quickly increase the retaining power of the device by turning the dial 16. This is located at the lower end of the reel 14, since the user's hands are usually below the reading matter 19. Our page holder's tension range does not exceed 0.6 N (2 oz)—since beyond that force, there is a tendency for the monofilament 18 to crush the page.

After use, the clamps 10L and 10R are detached from the support 17, and the reel 14 automatically stores the monofilament 18. The clamps 10L and 10R are secured to one another with magnets 13L and 13R or other attaching components, or simply clamped together.

Description and Operation of Alternative Embodiments—FIGS. 2-6

Figure 2:
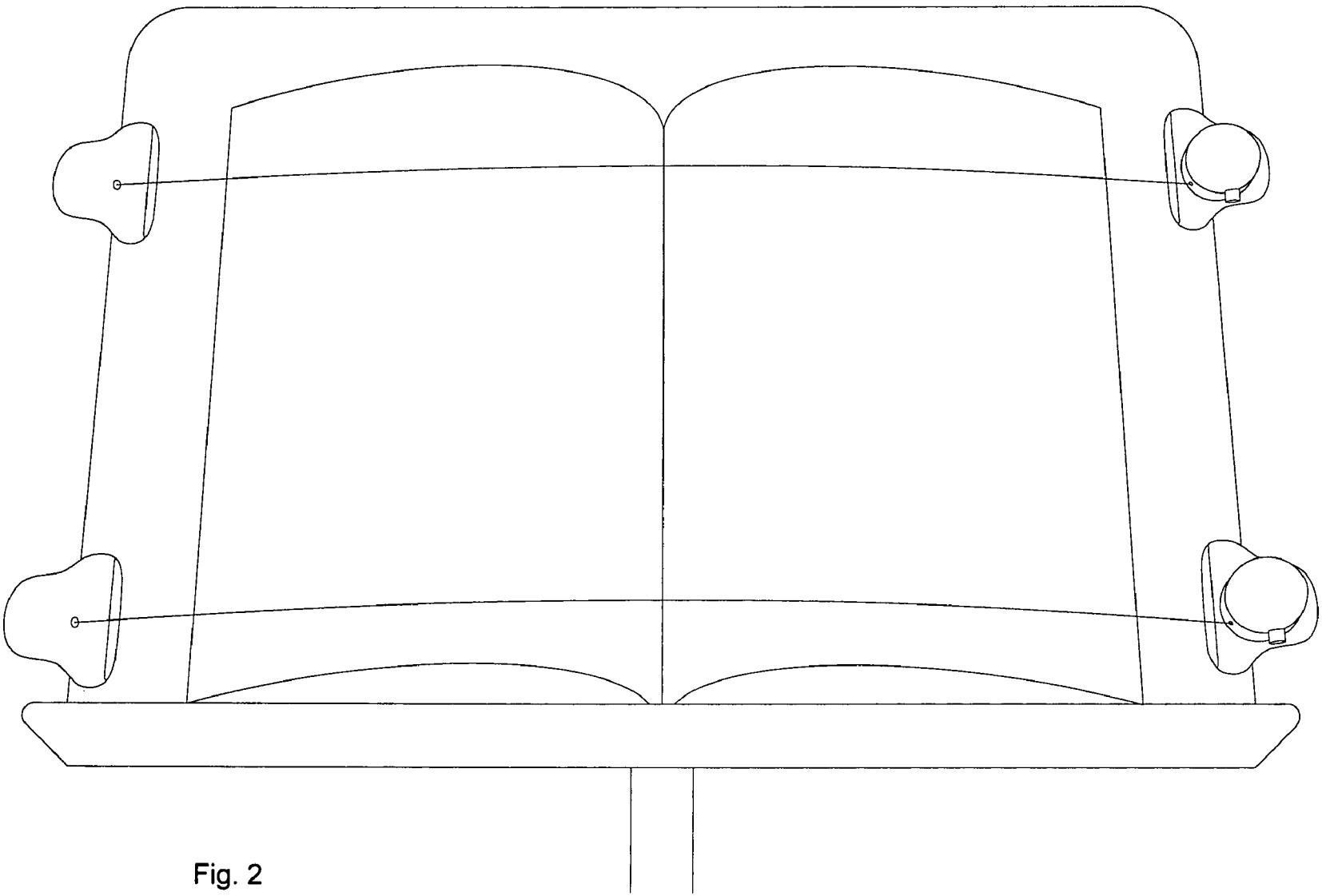
FIG. 2 is a view of two parallel units to compensate for moderate wind.

FIG. 2—Description of Two Parallel Units

When wind is strong enough to bend the pages' corners toward the center, two units may be placed along the top and bottom of the reading matter 19. The page is still turned normally. When two units are utilized, lower tension settings may be selected.

Figure 3:
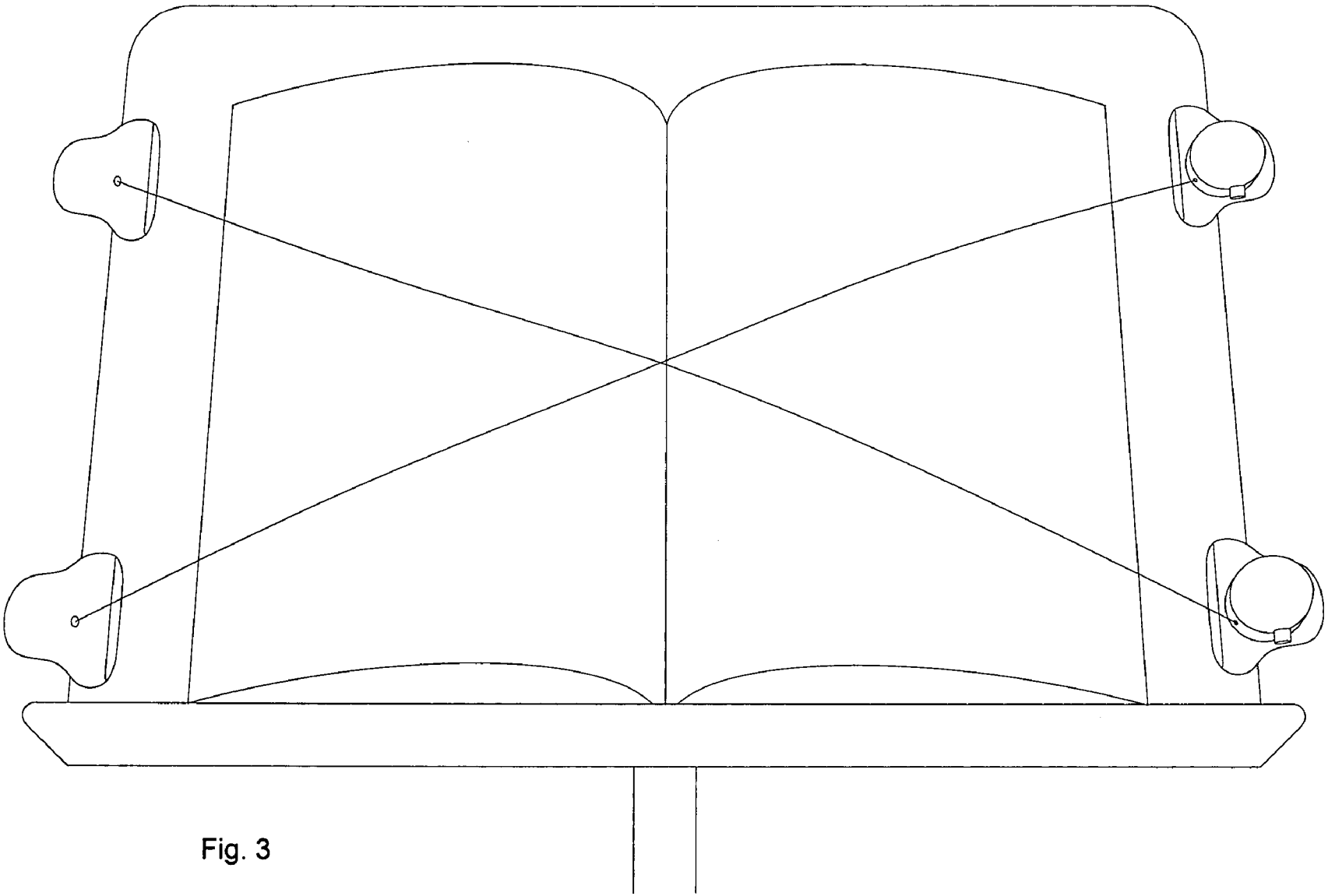
FIG. 3 is a view of two diagonal units to compensate for high wind.

FIG. 3—Description of Two Diagonal Units

A very strong wind can lift the middle of a page like a sail, pulling it out from the parallel units on top and bottom (FIG. 2). When conditions merit, two units may be placed diagonally across the reading matter 19. The page is still turned normally, and as conditions allow, the use of two units might permit a lower tension setting.

Figure 4:
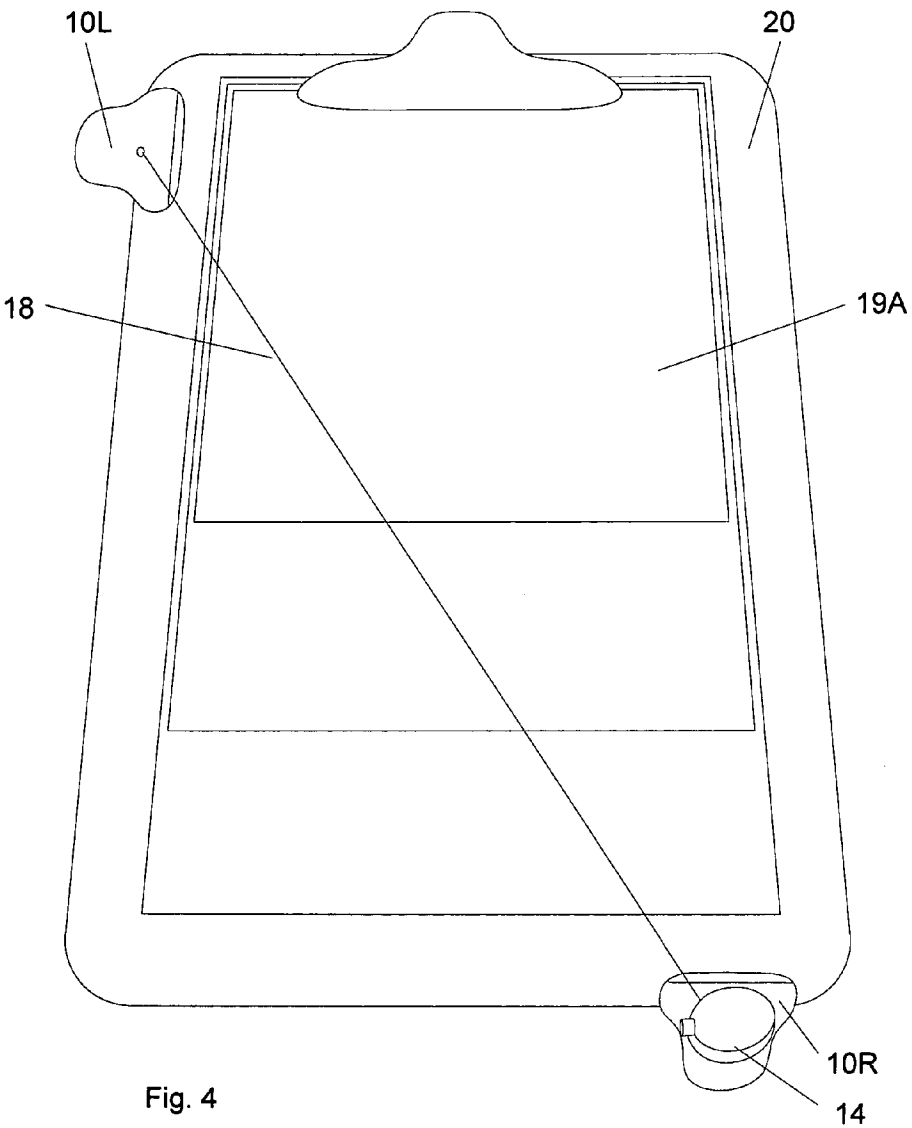
FIG. 4 is a view of our invention applied to a clipboard.

FIG. 4—Description of the Device Applied to a Clipboard

Use with a clipboard 20 presents the unique challenge of retaining the page, but allowing it to turn and to wrap over and around the top of the board 20. By placing the clamp 10R with the reel 14 at the base of the board 20 toward the right (this would best suit a right-handed user), the monofilament 18 can be extended diagonally up and left across the page. Placement of clamp 10L on the left side of the board 20, near the top, permits the page to be turned against, and eventually free of, the monofilament 18. The user can then wrap the page over and around the top of the board 20. If desirable, an optional component (not shown) to retain the wrapped pages against the back of the board 20 can be added.

Our page holder brings to the clipboard the distinct advantage of effective retention of varying lengths of paper 19A, even in combination. This embodiment can be manifested as a clipboard integrated with our page holder, or our device can be readily applied to an existing clipboard.

Figure 5:
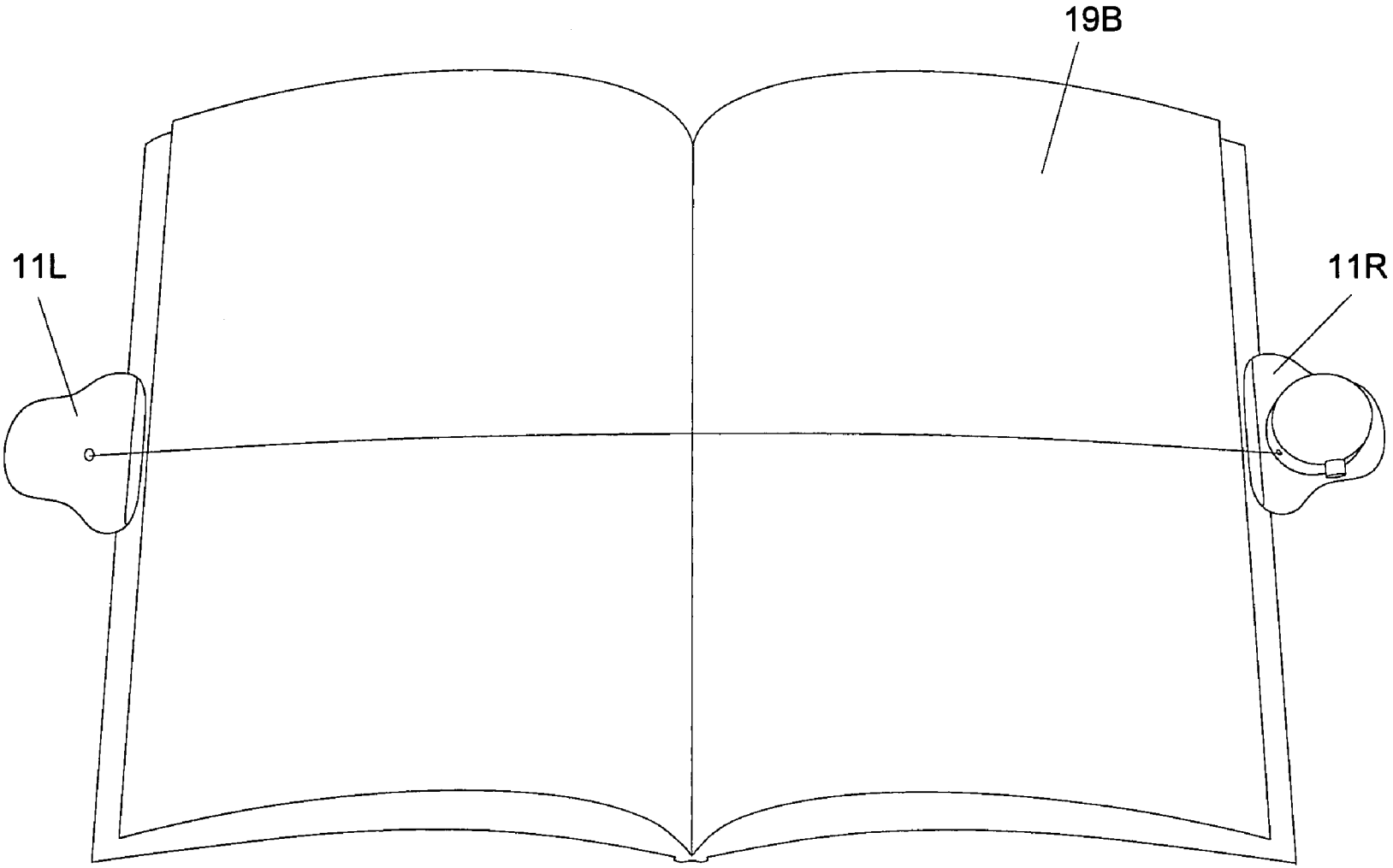
FIG. 5 is a view of our invention applied directly to a book.

FIG. 5—Description of the Device Applied Directly to a Book

The page holder can be placed directly on the covers of a hardcover or softcover book 19B. The clamps 11L and 11R are weighted to hold the bound book 19B open. This allows for hands-free reading in any setting. An alternative embodiment could include a support member across the back of the book (not shown). Our page holder can also be applied to any existing book holder.

Figure 6:
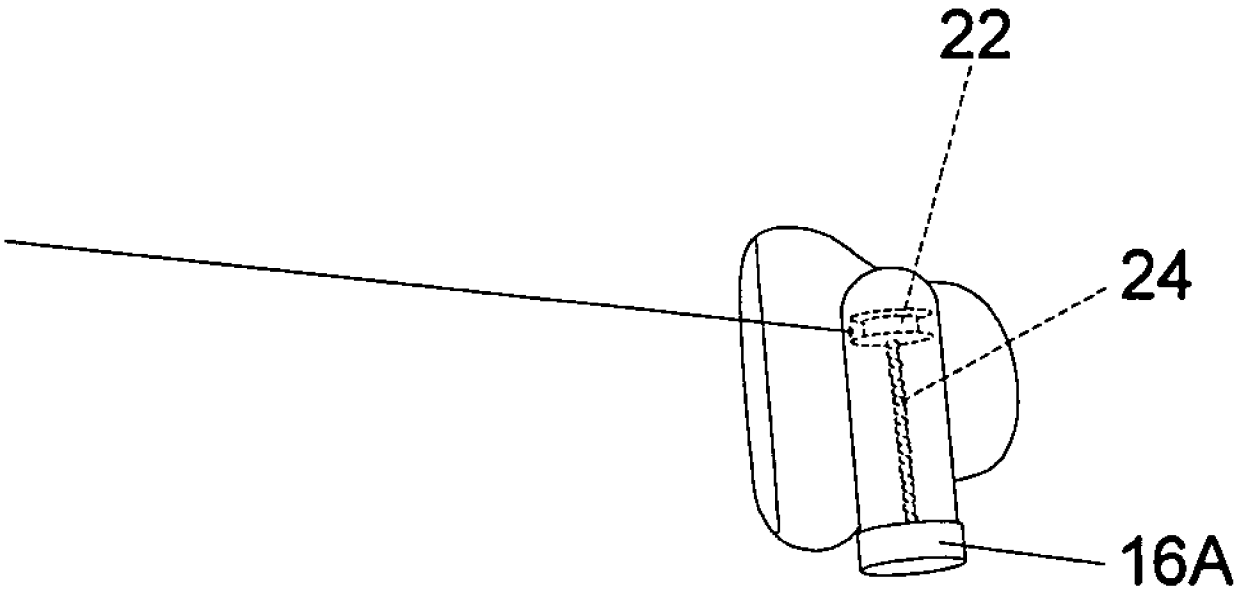
FIG. 6 is a view of an alternate tensioning mechanism.

FIG. 6—Description of an Alternate Reel Mechanism

Instead of a spring-biased reel, our page holder can also function using a reel 22 tensioned by means of a rubber band 24, a braided elastic band, or similar material. Tension is still increased by turning the tension adjustment dial 16*a*.

Conclusion, Ramifications, and Scope

Thus the reader will see that the page holder of the invention provides a highly reliable, compact, versatile, ingenious, yet economical device that can be used by students and professionals alike.

While our above description contains many specificities, these should not be construed as limitations on the scope of the invention, but rather as an exemplification of one preferred embodiment thereof. Many other variations are possible. For example, the page holder can be integrated with or used in combination with any existing book holder, easel, copy holder, etc. The number of units, or components thereof, can be increased or decreased.

"Reading matter" can be construed as books, newspapers, sheet music, photographs—any such material for viewing.

The clamps can be made from other materials such as plastic—and thus the clamps and reel casing can be molded as one piece; the clamps can be made in different colors, sizes, gripping capacities, strengths, and weights; and can be attached together in any suitable fashion for storage. Other methods can be used to attach the page holder, such as suction cups (e.g., on a polished wood piano or organ).

The reel casing can be made of metal, plastic, or any suitable material; and can be produced in various sizes or colors (including clear). The number of reels can be increased—such as an additional reel on the left side for greater ease if the reading matter is to be turned back and forth frequently. Any tensioning device which produces the proper range of force can function—including a hanging weight in place of a reel. The tension range can be increased to accommodate heavier reading matter. The reel can have a static tension, such as 0.6 N (2 oz), and not be adjustable. A ratcheting reel can be introduced, mounted to the left clamp (or other suitable place), to take up the slack of the monofilament for storage, e.g., at the push of a button.

The tension adjustment dial can alternatively be positioned on the face, side, or other surface of the reel. The tension can also be adjusted by a button, lever, knob, or other suitable hardware.

The monofilament can be a strand, cord, or band of any material that does not present threat of incision to the page's edge, or friction prohibitive of page turning. It can be made in varying thickness and weight to accommodate different reading materials. The monofilament can be made in any length to suit the device's application—such as 1.5 m (about 5 ft) to accommodate several sheets of music along a piano or organ.

The application of the page holder to a clipboard can be expanded to further retain the pages that have been turned up and wrapped behind the board.

Accordingly, the scope of the invention should be determined not by the embodiments illustrated, but by the appended claims and their legal equivalents.

We claim:

1. A page holder comprising:

(a) a tensioning mechanism set at a predetermined strength, being sufficiently strong to retain pages in an open position, yet sufficiently light to enable page turning, (b) a plurality of gripping members, and (c) a retaining line of predetermined length, (d) said tensioning mechanism being attached to one of said gripping members, and (e) said line being attached to said tensioning mechanism so that said tensioning mechanism feeds in additional line to enable page turning and subsequently retracts said additional line as the page turn is completed, (f) the other end of said line being attached to the second gripping member, and (g) the tensioning mechanism including a tension adjustment control that allows a user to vary tension which the tensioning mechanism applies to the retaining line, whereby said pages are retained in an open position, and whereby a user can turn said page without delay or encumbrance, and whereby the remaining pages are secure throughout the page turn.

2. The page holder of claim 1, wherein said gripping members are clamps.

3. The page holder of claim 1, wherein said tensioning mechanism is a self-retracting reel.

4. The page holder of claim 3, wherein said reel is spring-biased.

5. The page holder of claim 3, wherein said reel is biased by an elastic band.

6. The page holder of claim 1, wherein the force of tension ranges from approximately 0.05 N to 0.6 N.

7. The page holder of claim 1, wherein said line is a monofilament.

8. The page holder of claim 7, wherein said monofilament is made from polyvinyledine fluoride.

9. The page holder of claim 1, wherein said page holder is applied directly to a book.

10. A method of retaining pages while enabling unencumbered manual page turning, comprising:

(a) providing a page holder comprising a tensioning mechanism set at a predetermined strength, being sufficiently strong to retain pages in an open position, yet sufficiently light to enable page turning, said tensioning mechanism being attached to a first gripping member, and said tensioning mechanism dispensing a retaining line such that said tensioning mechanism feeds in additional line to enable page turning and subsequently retracts said additional line as the page turn is completed, the other end of said line being attached to a second gripping member, (b) providing a support for reading matter, and placing reading matter on said support, (c) attaching said gripping members to opposing edges of said support, and extending said line diagonally across said reading matter, whereby said pages are retained in an open position, and whereby a user can turn said page without delay or encumbrance, and whereby the remaining pages are secure throughout the page turn.

11. The method of claim 10, wherein said tensioning mechanism is a self-retracting reel.

12. The method of claim 11, wherein said reel is spring-biased.

13. The method of claim 11, further including a tension adjustment control on said reel.

14. The method of claim 10, wherein said line is a monofilament.

15. The method of claim 14, wherein said monofilament is made from polyvinyledine fluoride.

16. The method of claim 10, wherein said support is a clipboard.

17. A method of retaining pages while enabling unencumbered manual page turning, comprising:

(a) providing a page holder comprising a tensioning mechanism having a tension adjustment control, and sot at a predetermined strength, being sufficiently strong to retain pages in an open position, yet sufficiently light to enable page turning, said tensioning mechanism being attached to a firm gripping member, and said tensioning mechanism dispensing a retaining line such that said tensioning mechanism feeds in additional line to enable page turning and subsequently retracts said additional line as the page turn is completed, the other end of said line being attached to a second gripping member, the tension adjustment control allowing a user to vary tension which the tensioning mechanism applies to the retaining line, (b) providing a support for reading matter, and placing reading matter on said support, (c) attaching said gripping members to opposing edges of said support, and extending said line across said reading matter, whereby said pages are retained in an open position, and whereby a user can turn said pages without delay or encumbrance, and whereby the remaining pages are secure throughout the page turn.

18. The method of claim 17, wherein the force of tension ranges from approximately 0.05 N to 0.6 N.

19. A method of retaining pages while enabling unencumbered manual page turning comprising:

(a) providing a plurality of page holders, each comprising a tensioning mechanism set at a predetermined strength, being sufficiently strong to retain pages in an open position, yet sufficiently light to enable page turning, said tensioning mechanism being attached to a first gripping member, and said tensioning mechanism dispensing a retaining line such that said tensioning mechanism feeds in additional line to enable page turning and subsequently retracts said additional line as the page turn is completed, the other end of said line being attached to a second gripping member, (b) providing a support for reading matter, and placing reading matter on said support, (c) attaching said gripping members to opposing edges of said support, and extending said lines across said reading matter, whereby said pages are retained in an open position, and whereby a user can turn said page without delay or encumbrance, and whereby the remaining pages are secure throughout the page turn.

20. The method of claim 19, further including a tension adjustment control that allows a user to vary tension which the tensioning mechanism applies to the retaining line.

* * * * *

UNITED STATES PATENT AND TRADEMARK OFFICE

CERTIFICATE OF CORRECTION

PATENT NO. : 7,566,041 B2
APPLICATION NO. : 10/712281
DATED : July 28, 2009
INVENTOR(S) : Ibara et al.

It is certified that error appears in the above-identified patent and that said Letters Patent is hereby corrected as shown below:

Title page, item (75) inventors: Should read as follows,

-- Steven Stewart Ibara, San Carlos, CA;
Crystal Gwen Steinke, San Jose, CA;
Joel Harlan Jones, San Jose, CA;
Vicky Greenbaum, Redwood City, CA;
David A. Woodley Packard, Los Altos Hills, CA;
Elisa Marie Jansen, San Jose, CA; --.

Signed and Sealed this

Twenty-second Day of December, 2009

David J. Kappos

David J. Kappos
*Director of the United States Patent and Trademark Office*